US006220037B1

(12) United States Patent
Heilman

(10) Patent No.: US 6,220,037 B1
(45) Date of Patent: Apr. 24, 2001

(54) CRYOGENIC PUMP MANIFOLD WITH SUBCOOLER AND HEAT EXCHANGER

(75) Inventor: Paul W. Heilman, Duncan, OK (US)

(73) Assignee: Halliburton Energy Services, Inc., Duncan, OK (US)

( * ) Notice: Subject to any disclaimer, the term of this patent is extended or adjusted under 35 U.S.C. 154(b) by 0 days.

(21) Appl. No.: 09/363,430

(22) Filed: Jul. 29, 1999

(51) Int. Cl.[7] ..... F17C 13/00
(52) U.S. Cl. ..... 62/50.6; 417/901
(58) Field of Search ..... 62/50.1, 50.2, 62/50.6; 417/901

(56) References Cited

U.S. PATENT DOCUMENTS 2,632,302 * 3/1953 Steele ..... 62/50.1
2,657,541 * 11/1953 Schilling ..... 62/50.1
3,131,713 * 5/1964 Kelley ..... 62/50.6
3,309,883 3/1967 Waterman ..... 62/45
4,932,214 * 6/1990 Nieratscher ..... 62/50.6
5,477,691 12/1995 White ..... 62/50.2

* cited by examiner

*Primary Examiner*—Ronald Capossela
(74) *Attorney, Agent, or Firm*—Robert A. Kent; Neal R. Kennedy

(57) ABSTRACT

A cryogenic pump manifold with subcooler and heat exchanger. The manifold comprises an inlet header with a subcooler disposed around it and a heat exchanger on the inlet side of the inlet header and subcooler. An expansion device is disposed between the inlet header and subcooler, and some liquid is diverted from the header and evaporated into a gas through the expansion device thereby lowering the temperature of the expanded gas which provides significant cooling to the cryogenic liquid entering the suction of the pump. An ejector may be positioned in the exhaust line from the heat exchanger to increase the flow rate, resulting in even more cooling. The cooling improves the overall performance of the pump and increases the ambient temperature range of operation of the pump. A method of cooling cryogenic liquid entering the suction of a pump is also disclosed.

30 Claims, 3 Drawing Sheets

CRYOGENIC PUMP MANIFOLD WITH SUBCOOLER AND HEAT EXCHANGER

BACKGROUND OF THE INVENTION

1. Field of the Invention

This invention relates to manifolds for pumps used in handling cryogenic liquids, and more particularly, to a cryogenic pump manifold that utilizes a subcooler and heat exchanger to cool liquid entering the pump.

2. Description of the Prior Art

Cryogenic liquids are those which must be greatly refrigerated to keep them in a liquid state under reasonable pressures. Liquid nitrogen is one example. Various equipment has been developed for the handling and storage of such liquids, including pumps for transferring the liquid from one location to another, such as from a storage container to another area in which the liquid will be utilized. One type of pump which has been used for this purpose is a reciprocating piston or plunger pump, such as the Halliburton Triplex pump. Typically, an inlet or suction manifold is mounted on the pump connecting the pump suction to a source of the cryogenic liquid. It is desirable to provide the coldest possible cryogenic liquid to the pump inlet because this is necessary to meet the most efficient net positive suction head (NPSH) requirements of the pump. In all cryogenic pumps, the lower the suction fluid temperature the better will be the overall performance of the pump.

Insulating the suction manifold and inlet piping for the pump keeps the incoming liquid cool. This has the limitation of the capabilities of the insulation depending upon ambient conditions, and, of course, provides no additional cooling. One device which has been developed and which has had success in providing some cooling is a cryogenic subcooler on the pump inlet. A cryogenic subcooler is a device that takes the pressurized cryogenic liquid and uses a portion of it to produce a low temperature within the subcooler. This subcooler temperature is lower than the inlet liquid temperature because the portion of the inlet liquid that is released from the liquid flow to the subcooler is passed through an expansion device. This expansion usually causes the liquid to evaporate or "flash." The expansion and evaporation of the liquid into a gaseous state causes the temperature to drop and lowers the subcooler temperature. The lower temperature expanded gas reduces the temperature of the pressurized inlet liquid entering the pump, producing a refrigerated or "conditioned" liquid.

Previous subcoolers may not be able to create enough heat transfer in some cases, so that the liquid entering the pump is not adequately cooled to meet the pump NPSH requirements to obtain optimum pump performance. Therefore, there is a need for greater subcooling.

The present invention solves these problems by incorporating a heat exchanger in conjunction with the subcooler to increase heat transfer and provide more cooling of the liquid entering the pump through the suction manifold.

Another problem with inadequate subcooling is that prolonged ambient heat gain may mean that the pump cannot function for a long period of time. Therefore, there is also a need for more cooling to overcome this problem. The present invention addresses this in that the greater exchange of heat in the apparatus results in an elimination of, or at least reduction in, ambient heat gain that provides longer running periods for the pump.

An alternate embodiment of the present invention increases the cooling even more by increasing the evaporation of liquid through the subcooler and heat exchanger through use of a fluid ejector or jetting device.

SUMMARY OF THE INVENTION

The present invention is an inlet or suction manifold or system for a cryogenic pump. The manifold comprises a subcooler and a heat exchanger which uses expanded gas to cool the cryogenic liquid entering the suction of the pump.

The invention may be described as an inlet system for a cryogenic pump which comprises an inlet header connectable to an inlet of the pump and a heat exchanger having a cooling side and a coolant side. The cooling side is in communication with the inlet header. The apparatus further comprises an expansion device in communication with the inlet header and the coolant side of the heat exchanger, such that some cryogenic liquid may be flowed out of the inlet header to the expansion device, expanded or evaporated into a gas through the expansion device whereby a temperature of the gas is lowered, and flowed through the coolant side of the heat exchanger, thereby lowering a temperature of the cryogenic liquid flowing thorough the cooling side of the heat exchanger.

The heat exchanger is preferably a shell and tube heat exchanger. The tube side of the heat exchanger is the cooling side. The shell side of the heat exchanger is the coolant side.

The system further comprises a jacket disposed around the inlet header forming a subcooler, and the jacket is in communication with the expansion device and the coolant side of the heat exchanger. The jacket and shell side are preferably integrally attached, and the inlet header and the tube side are also preferably integrally attached.

The system further comprises a coolant outlet in communication with the coolant side of the heat exchanger through which evaporated gas may be discharged. In one embodiment, the gas is exhausted or vented through the coolant outlet to the atmosphere.

In an alternate embodiment, the system further comprises an ejector having an inlet port or fluid inlet in communication with the coolant outlet, a jetting port or inlet connectable to a secondary gas source, and an ejector outlet port or fluid outlet. The secondary gas may be air, another gas from a separate gas source, or waste gas vented from the pump.

The expansion device may comprises an orifice or may be characterized by other devices such as a valve.

The present invention may also be described as a method of cooling liquid flowing through a cryogenic pump inlet header, the method comprising the steps of (a) connecting a cooling side of a heat exchanger to the inlet header, (b) diverting a portion of the liquid through an expansion device, (c) expanding the gas through the expansion device and expanding the liquid into a gas, thereby reducing a temperature of the gas, and (d) flowing cooled gas from the expansion device through a coolant side of the heat exchanger such that liquid flowing through the cooling side thereof is cooled. Step (d) preferably comprises flowing the cooled gas through a shell side of a shell and tube heat exchanger and flowing liquid to the inlet header through a tube side of the heat exchanger.

The method may further comprise the step of (e) exhausting the gas from the heat exchanger. Step (e) may comprise venting the gas to the atmosphere and/or increasing exhausted gas flow using a gas ejector. Step (e) also may comprise connecting the ejector to a secondary gas supply. The secondary gas is preferably selected from the group consisting of air or nitrogen. The secondary gas may also be supplied by venting the secondary gas from the pump.

In the method, step (d) may additionally comprise flowing the cooled liquid through a subcooler in communication with the coolant side of the heat exchanger.

Numerous objects and advantages of the invention will become apparent as the following detailed description of the invention is read in conjunction with the drawings that illustrate such embodiment.

DESCRIPTION OF THE PREFERRED EMBODIMENT

Figure 1:
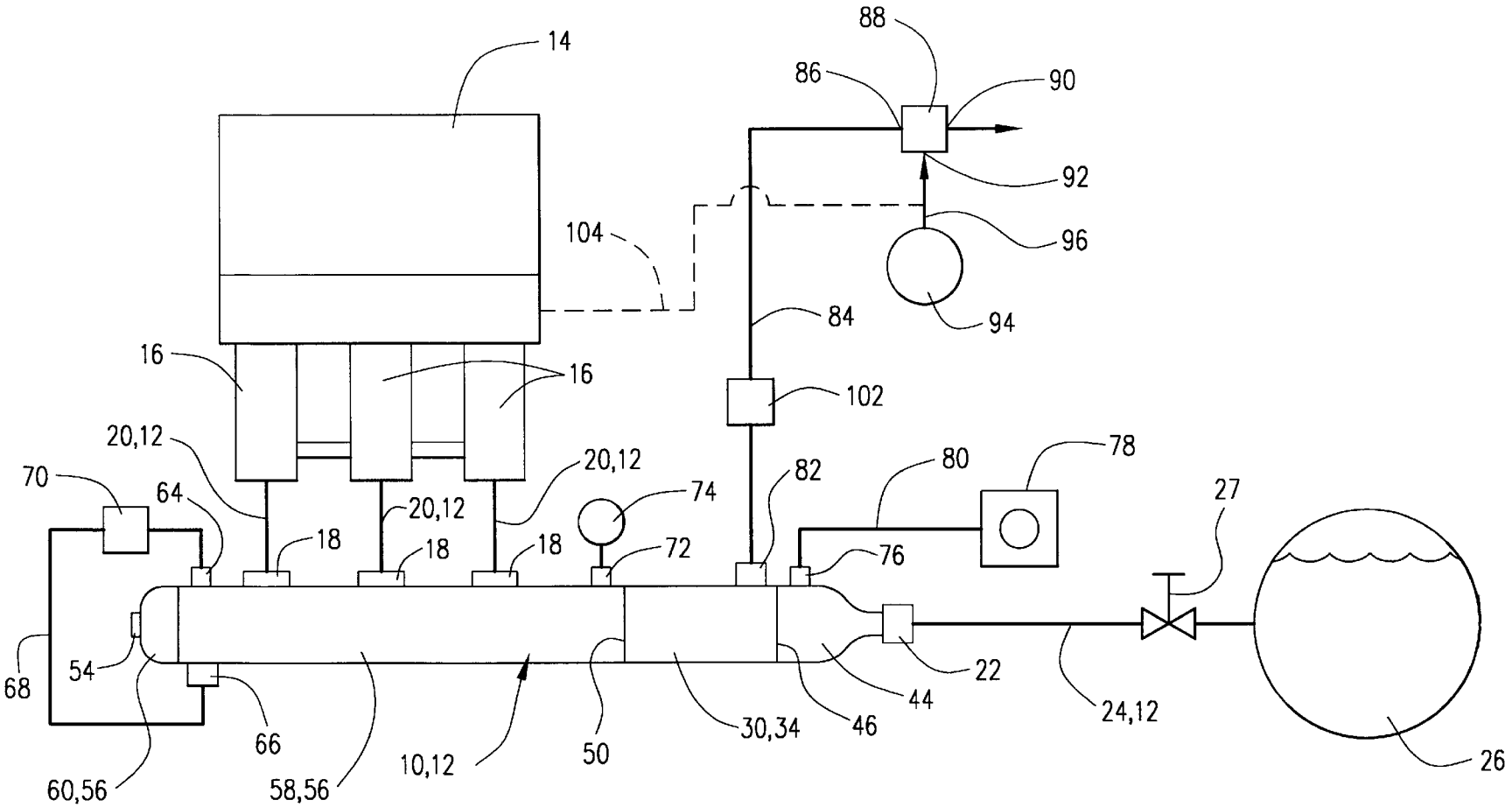
FIG. 1 schematically shows the cryogenic pump manifold with subcooler and heat exchanger of the present invention connected in the inlet or suction piping of a cryogenic pump.

Referring now to the drawings, and more particularly to FIG. 1, the cryogenic pump manifold with subcooler and heat exchanger of the present invention is shown and generally designated by the numeral 10. Manifold 10, also referred to as an inlet or suction manifold or system 10 is shown schematically as a portion of inlet or suction piping 12 for a cryogenic pump 14. Manifold 10 is well adapted for use with any cryogenic liquid, such as liquid nitrogen, and is not intended to be limited to any particular material.

Pump 14 is illustrated herein as a known piston or plunger pump, such as the Halliburton Triplex pump, but the invention is not intended to be limited to any particular pump configuration. Pump 14 is driven by a prime mover (not shown) and has a plurality of cylinders 16, each of which is connected to a manifold outlet port 18 on manifold 10 by a pump inlet or suction line 20.

The cryogenic liquid is supplied to an inlet 22 of manifold 10 through a supply line 24 which is a portion of suction piping 12 extending from a cryogenic storage tank 26. A control valve 27 controls flow of cryogenic liquid from storage tank 26. Other conventional items in suction piping 12 are omitted for clarity.

Figures 2, 3:
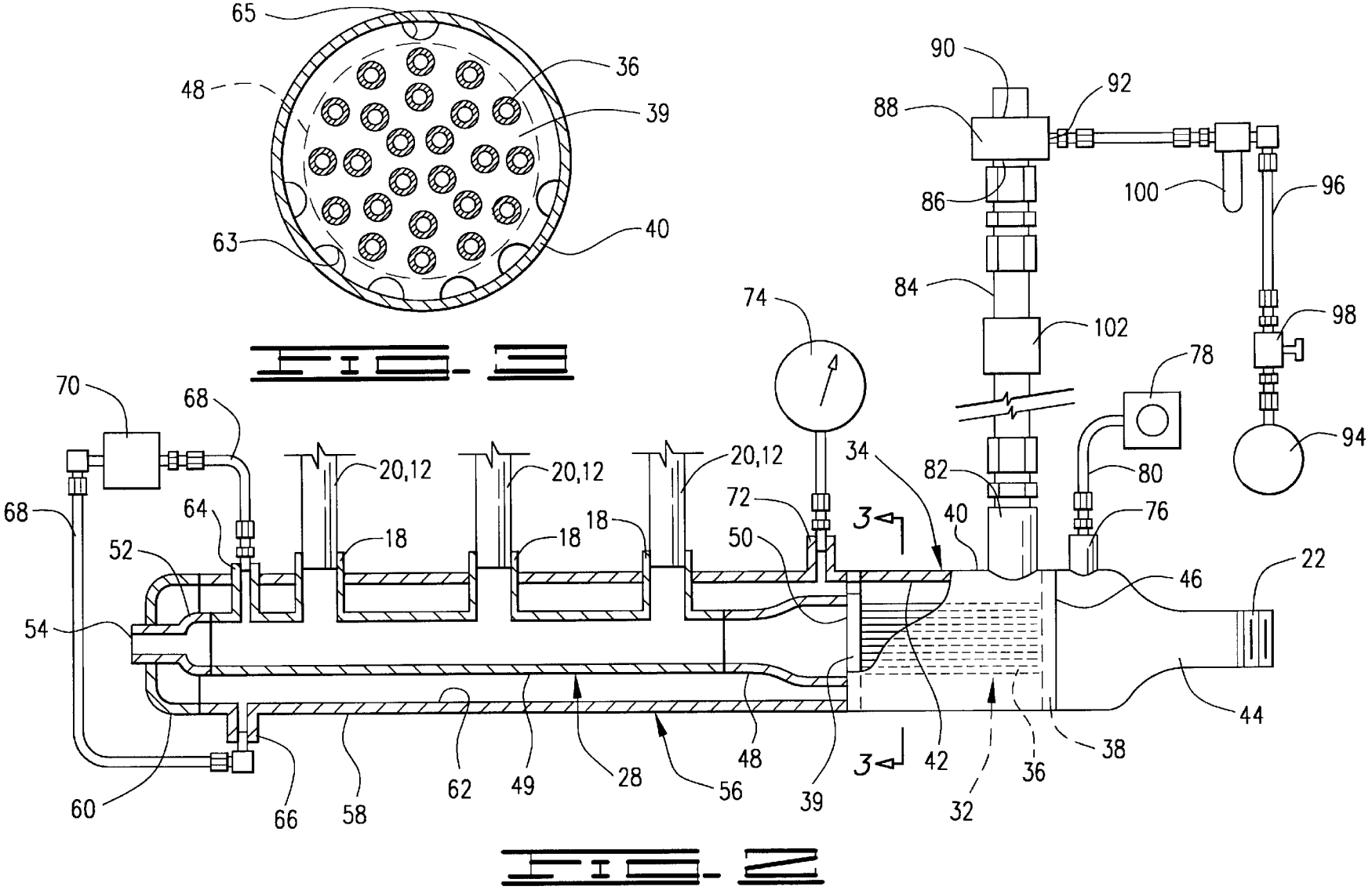
FIG. 2 shows a cross section of a first embodiment of the manifold exhausted to the atmosphere with a portion of the piping connections associated therewith and a second embodiment utilizing an ejector.
FIG. 3 is a cross section taken along lines 3—3 in FIG. 2.

Referring now also to FIG. 2, the details of a first embodiment of manifold 10 will be discussed. Manifold 10 comprises an inlet or suction header portion 28 and a heat exchanger portion 30. Heat exchanger 30 is preferably adjacent to suction header 28 as illustrated, but can actually be spaced therefrom and connected thereto by piping.

Heat exchanger 30 is preferably of conventional, shell and tube construction having a first, tube side 32 and a second, shell side 34. Tube side 32 comprises a plurality of tubes 36 extending between an inlet end plate 38 and an outlet end plate 39. See also FIG. 3. Tubes 36 are integrally attached to end plates 38 and 39 such as by welding or braising. Shell side 34 comprises an outer shell 40 which extends between end plates 38 and 39 and is also integrally attached thereto such as by welding or braising so that a shell chamber 42 is formed therein. It will be seen by those skilled in the art that shell chamber 42 is not in communication with tubes 36.

An inlet nipple or reducer 44 is attached to an inlet end 46 of heat exchanger 30 adjacent to inlet end plate 38. Inlet nipple 44 is in communication with tubes 36 but is prevented from communication with shell chamber 42 by inlet end plate 38.

An outlet nipple or reducer 48 is attached at one end to an outlet end 50 of heat exchanger 30 adjacent to outlet end plate 39. Outlet nipple 48 is in communication with tubes 36 but is prevented from communication with shell chamber 42 by outlet end plate 39.

The other end of outlet nipple or reducer 48 is attached to one end of a cylindrical portion 49 of suction header 28, and the outlet nipple may be considered a part of suction header 28. An opposite end of suction header 28 is closed by an end cap 52. An access port 54 may be attached to end cap 52 to provide access to suction header 28, as necessary, such as for instrumentation. Previously mentioned manifold discharge ports 18 are attached to cylindrical portion 49 of inlet header 28, forming an integral portion thereof. It will be seen that discharge ports 18 on manifold 10 are in communication with storage tank 26 through supply line 24, inlet 22, inlet nipple 44, tube side 32 of heat exchanger 30, outlet nipple 48 and inlet header 28. In other words, cryogenic gas in storage tank 26 is communicated to pump suction lines 20.

Manifold 10 further comprises a subcooler portion 56 which is characterized in the preferred embodiment by a cylindrical portion 58 attached at one end to outlet end 50 of heat exchanger 30 and closed at the opposite end by an end cap 60. Subcooler 56 thus substantially encloses cylindrical portion 49, outlet nipple 48 and end cap 52 of suction header 28. Thus, subcooler 56 may also be referred to as a jacket 56 defining a subcooler chamber 62 around suction header 28.

Subcooler chamber 62 is in communication with shell chamber 42 of heat exchanger by means of a plurality of ports 63. Ports 63 are preferably formed in the lower half of end plate 39 so that the cooled gas is forced into the lower part of shell chamber 42 to then flow up across tubes 36 to increase cooling. A single port 65 is defined in the upper portion of end plate 39 to act as a relief which prevents formation of a stagnant area of gas in the upper part of shell chamber 42. Manifold discharge ports 18 extend through subcooler chamber 62 and cylindrical portion 58 of subcooler 56 but are not in communication with subcooler chamber 62. Access port 54 extends through end cap 60 of subcooler 56 but also is not in communication with subcooler chamber 62.

A header vent or expansion port 64 is attached to cylindrical portion 49 of suction header 28, extending through subcooler chamber 62 and cylindrical portion 58 of subcooler 56. Header vent port 64 is not in communication with subcooler chamber 62. A subcooler vent or expansion port 66 is attached to cylindrical portion 58 of subcooler 56 and is in communication with subcooler chamber 62.

A vent line 68 is connected between header vent port 64 and subcooler vent port 66 thereby placing the vent ports in communication with one another. An expansion device 70 is disposed in vent line 68. Thus, as will be further described herein, a portion of liquid in suction header 28 will flow through vent line 68 to subcooler chamber 42 while being expanded, and correspondingly evaporated into a gas and cooled, through expansion device 70. In the preferred embodiment, expansion device 70 is characterized by a known orifice, interchangeable with other orifices of various sizes. However, expansion device 70 may also be a controllable device such as a valve.

A gauge port 72 may be attached to cylindrical portion 58 of subcooler 56. Gauge port 72 is adapted for connection with a vacuum gauge 74 and/or other instrumentation for monitoring vacuum and/or other conditions in subcooler chamber 62.

An instrumentation port 76 is attached to inlet nipple 44 and is connectable to a gauge or instrument panel 78 by an instrument line 80.

A shell outlet 82 is attached to shell 40 of shell side 32 of heat exchanger 30 and is in communication with shell chamber 42. A heat exchanger outlet or discharge line 84 is connected to shell outlet 82. See FIGS. 1 and 2.

In a first preferred embodiment, discharge line 84 is simply exhausted or vented to the atmosphere. As will be further discussed herein, this allows flow of vented gas through subcooler 56 and heat exchanger 30.

A second embodiment is also illustrated in FIG. 2. In this embodiment, discharge line 84 is not exhausted directly to the atmosphere. Instead, discharge line 84 is connected to a fluid inlet 86 of a fluid ejector or eductor 88 of a kind known in the art. Ejector 88, which may also be referred to as a jetting device 88, further has a fluid outlet 90 which is exhausted or vented to the atmosphere and a jetting inlet 92. When a high-pressure secondary gas is supplied to jetting inlet 92 of ejector 88, the flow rate of fluid therethrough is substantially increased. Such a high-pressure gas may be supplied from a separate gas source, such as a gas storage tank 94, through a gas line 96. Gas line 96 may have a control valve 98 therein. This gas can be any non-hazardous gas, such as air or nitrogen. FIG. 2 illustrates an example of gas line 96 for an air source. In this case, an air dryer 100 is disposed in gas line 96 to knock out moisture from the air stream. A heat exchanger 102 may also be included in discharge line 84 to warm the discharged gas as necessary to prevent freezing in ejector 88.

Figure 4:
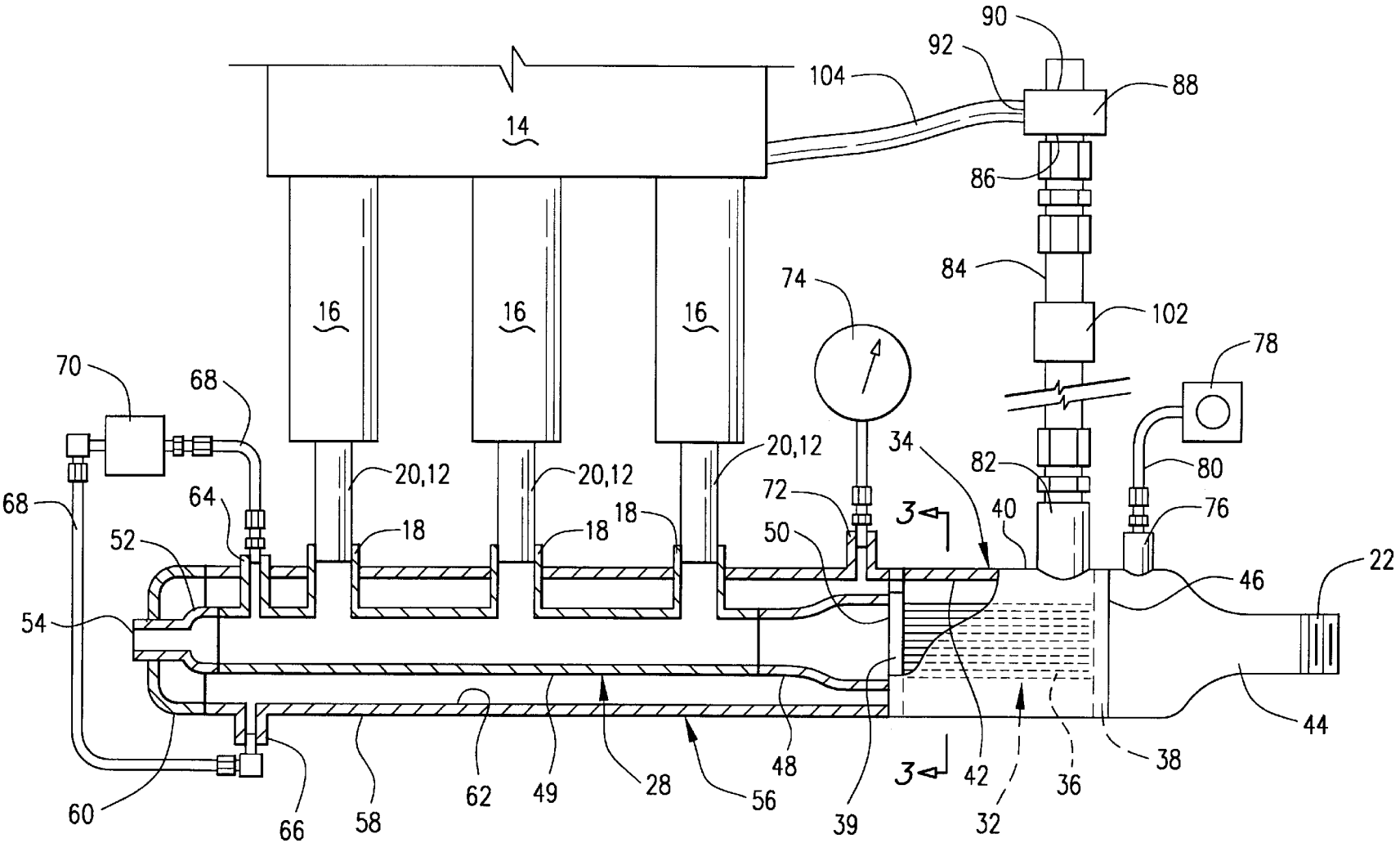
FIG. 4 is a third embodiment of the invention which is a variation of the second embodiment but in which the ejector is connected to waste high pressure gas vented from the pump.

Referring now to FIG. 4, a third embodiment of manifold 10 and its associated piping is shown. Actually, the third embodiment is a variation on the second embodiment in that the third also utilizes ejector 88. In this case, a portion of pump 14 is connected to jetting inlet 92 of ejector 88 by a pump vent line. Thus, waste high pressure gas may be communicated or vented from pump 14 to jetting inlet 92.

Operation of the Invention

In operation, manifold 10 is installed in one of the ways previously shown and described. The cryogenic liquid is flowed from storage tank 26 by opening control valve 27 in supply line 24. Pump 14 is operated in a known manner. Thus, the cryogenic liquid will flow from storage tank 26 to the suction of pump 14. Any of inlet piping 12, including manifold 10 may have insulation installed thereon in a known manner. Such insulation is not shown in the drawings for clarity.

A portion of the liquid is vented from suction header 28 to subcooler 56 through expansion device 70. As is well known, rapid expansion of a liquid into its gaseous state will result in a decrease in temperature thereof. The cooled gas passes through subcooler 56 and heat exchanger 30 and is discharged from manifold 10 through shell outlet 82. Thus, cooled gas enters subcooler 56 and provides some direct cooling to suction header 28 and the cryogenic liquid flowing therethrough. Because the cooled, expanded gas also passes through shell side 34 of heat exchanger 30, additional cooling is provided to the cryogenic liquid flowing to pump 14 though tube side 32 of the heat exchanger. In fact, because of the heat transfer efficiency of heat exchanger 30, most of the cooling will be done in it rather than in subcooler 56.

For the first embodiment, the gas discharged from manifold 10 is simply exhausted to the atmosphere through line 84 as previously described. The gas could also be scavenged by a compressor (not shown) or similar apparatus if it is undesirable to vent it to the atmosphere.

The first embodiment will provide significant cooling to the cryogenic liquid entering pump 14 which results in improvement in the performance of pump 14 by meeting, or coming close to, the NPSH requirements of pump 14. This keeps the cryogenic liquid in its liquid state.

If additional cooling is desired, the use of ejector 88 may be incorporated as in the second and third embodiments previously described. In either case, the pressurized gas in gas line 96 enters jetting inlet 92 of ejector 88 with relatively high velocity which results in a significantly increased pressure drop of the cryogenic gas though the ejector. The general operation of ejectors is known. The increased pressure drop, of course, causes a greater and more rapid expansion of the cryogenic liquid in expansion device 70 so that it is even cooler as it passes through subcooler 56 and heat exchanger 30, thereby further cooling the cryogenic liquid flowing to the suction of pump 14. The pressure in a typical subcooler is approximately atmospheric, or 14.7 psia at sea level. For nitrogen, this pressure limits the temperature of the expanding gas to approximately −320 degrees F. The use of ejector 88 causes the exhaust pressure to drop below what is shown on vacuum gauge 74. This lowered pressure will force the refrigerated gas temperature to drop well below −320 degrees F., and in turn, further lower the temperature of the liquid entering the suction of pump 14. This enhancement not only improves the efficiency of manifold 10, but also increases the ambient temperature range of operation for pump 14.

It will be seen, therefore, that cryogenic pump manifold with subcooler and heat exchanger of the present invention is well adapted to carry out the ends and advantages mentioned as well as those inherent therein. While presently preferred embodiments of the invention have been shown for the purposes of this disclosure, numerous changes may be made n the arrangement and construction of the parts. All such changes are encompassed within the scope and spirit of the appended claims.

What is claimed is:

1. An inlet system for a cryogenic pump, said system comprising:

an inlet manifold comprising:

an inlet header connectable to an inlet of the pump and to a source of cryogenic liquid; and a subcooler disposed around said inlet header;

a heat exchanger having a cooling side and a coolant side, said cooling side being in communication with said inlet header and said coolant side being in communication with said subcooler; and an expansion device in communication with said inlet header and said coolant side of said heat exchanger, such that cryogenic liquid may be:

flow out of said inlet header to said expansion device;

expanded into a gas through said expansion device whereby the temperature of the gas is lowered; and flowed through said subcooler and said coolant side of said heat exchanger thereby lowering the temperature of said cryogenic liquid flowing through said header and said cooling side of said heat exchanger.

2. The system of claim 1 wherein said heat exchanger is a shell and tube heat exchanger.

3. The system of claim 2 wherein the tube side of said heat exchanger is the cooling side.

4. The system of claim 2 wherein the shell said of said heat exchanger is the coolant side.

5. The system of claim 4 wherein said subcooler and said shell side of said heat exchanger are integrally attached.

6. The system of claim 4 wherein said inlet header and said tube side of said heat exchanger are integrally attached.

7. The system of claim 1 further comprising a coolant outlet in communication with said coolant side of said heat exchanger through which the gas may be discharged.

8. The system of claim 7 wherein the gas is vented through said coolant outlet to the atmosphere.

9. The system of claim 8 further comprising:

an ejector having an inlet port in communication with said coolant outlet, a jetting port connectable to a secondary gas source, and an outlet port.

10. The system of claim 9 wherein the secondary gas source is air.

11. The system of claim 9 wherein the secondary gas source is gas vented from the pump.

12. The system of claim 1 wherein said inlet header, said subcooler and said heat exchanger are integrally formed.

13. The system of claim 1 wherein said expansion device comprises an orifice.

14. The system of claim 1 wherein said expansion device comprises a valve.

15. A suction manifold for a cryogenic pump said manifold comprising:

a suction header connectible to a suction side of said pump;

a cryogenic subcooler adjacent to said suction header;

a heat exchanger having a first side in communication with said suction header and a second side in communication with said subcooler; and an expansion device connected to said suction header and said subcooler, such that cryogenic liquid may be expanded into a gas as it is flowed from said suction header to said subcooler and said second side of said heat exchanger, thereby lowering the temperature of said gas which provides cooling for liquid flowing through said first side of said heat exchanger and said suction header.

16. The manifold of claim 15 wherein:

said first side is a cooling side; and said second side is a coolant side.

17. The manifold of claim 16 wherein said heat exchanger is a shell and tube heat exchanger in which said first side is a tube side and said second side is a shell side thereof.

18. The manifold of claim 15 wherein said suction header, said subcooler and said heat exchanger are integrally formed.

19. The manifold of claim 15 further comprising a coolant outlet in communication with said second side of said heat exchanger for exhausting said gas therefrom.

20. The manifold of claim 19 wherein said gas is vented through said coolant outlet to the atmosphere.

21. The manifold of claim 19 further comprising an ejector having a fluid inlet in communication with said coolant outlet, a jetting inlet connectable to a secondary gas source, and a fluid outlet.

22. The manifold of claim 21 wherein the secondary gas source is air.

23. The manifold of claim 22 wherein the secondary gas source is gas vented from the pump.

24. A method of cooling liquid flowing through a cryogenic pump inlet header, said method comprising the steps of:

(a) connecting a cooling side of a heat exchanger to the inlet header;

(b) connecting a coolant side of said heat exchanger to a subcooler disposed adjacent to said inlet header;

(c) diverting a portion of said liquid through an expansion device;

(d) expanding said portion of liquid into a gas through said expansion device, thereby reducing a temperature of the gas; and (e) flowing cooled gas from said expansion device through said subcooler and said coolant side of said heat exchanger such that liquid flowing through said cooling side of said heat exchanger and through said inlet header is cooled.

25. The method of claim 24 wherein step (e) comprises:

flowing said cooled gas through a shell side of a shell and tube heat exchanger; and flowing liquid to said inlet header through a tube side of said heat exchanger.

26. The method of claim 24 further comprising:

(f) exhausting said gas from said heat exchanger.

27. The method of claim 26 wherein step (f) comprises:

increasing flow of the exhausted gas with an ejector.

28. The method of claim 27 wherein step (f) comprises connecting said ejector to a secondary gas supply.

29. The method of claim 28 wherein said secondary gas is selected from the group consisting of air or nitrogen.

30. The method of claim 28 wherein said secondary gas is supplied by venting the secondary gas from the pump.

* * * * *